US007612724B2

(12) United States Patent
Kim et al.

(10) Patent No.: US 7,612,724 B2
(45) Date of Patent: Nov. 3, 2009

(54) DUAL-BAND INVERTED F ANTENNA REDUCING SAR

(75) Inventors: Yong-jin Kim, Yongin-si (KR); Gyoo-soo Chae, Yongin-si (KR); Young-eil Kim, Yongin-si (KR); Ick-jae Yoon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/703,199

(22) Filed: Feb. 7, 2007

(65) Prior Publication Data

US 2008/0055160 A1 Mar. 6, 2008

(30) Foreign Application Priority Data

Aug. 29, 2006 (KR) ..... 10-2006-0082099

(51) Int. Cl.

| | |
|---|---|
| ***H01Q 1/38*** | (2006.01) |
| ***H01Q 1/24*** | (2006.01) |
| ***H01Q 9/38*** | (2006.01) |
| ***H01Q 1/48*** | (2006.01) |

(52) U.S. Cl. ..... 343/702; 343/700 MS; 343/829; 343/845; 343/846

(58) Field of Classification Search ..... 343/700 MS, 343/702, 829, 845, 846
See application file for complete search history.

(56) References Cited

U.S. PATENT DOCUMENTS

| | | | | |
|---|---|---|---|---|
| 6,326,921 | B1 * | 12/2001 | Egorov et al. | 343/700 MS |
| 6,963,310 | B2 * | 11/2005 | Horita et al. | 343/702 |
| 7,091,911 | B2 * | 8/2006 | Qi et al. | 343/702 |
| 2003/0169206 | A1 * | 9/2003 | Egawa | 343/702 |

* cited by examiner

*Primary Examiner*—Douglas W Owens
*Assistant Examiner*—Jennifer F Hu
(74) *Attorney, Agent, or Firm*—Sughrue Mion, PLLC

(57) ABSTRACT

An inverted F antenna (IFA) which reduces specific absorption rate (SAR) includes a ground; an auxiliary radiator which is attached to one end of the ground and disposed along a plane direction of the ground; a radiator which lies at an interval from the auxiliary radiator in parallel and radiates electromagnetic waves; a feed which supplies current to the radiator; and a short which interconnects the radiator with the ground and discharges the current to the ground. Accordingly, the SAR can be decreased and the antenna size can be miniaturized.

11 Claims, 5 Drawing Sheets

DUAL-BAND INVERTED F ANTENNA REDUCING SAR

CROSS-REFERENCE TO RELATED APPLICATIONS

This application claims priority from Korean Patent Application No. 10-2006-0082099, filed Aug. 29, 2006, in the Korean Intellectual Property Office, the entire contents of which is incorporated herein by reference.

BACKGROUND OF THE INVENTION

1. Field of the Invention

Apparatuses consistent with the present invention relate to a dual-band inverted F antenna having a reduced specific absorption rate (SAR), and more particularly, to a dual-band inverted F antenna having a reduced SAR and a small size.

2. Description of the Related Art

An inverted F antenna (IFA) has been suggested to address the direct exposure of the electromagnetic waves to users when the external antenna is used adjacent to the head of the user.

Since the IFA, which is a built-in antenna, can be embedded in a mobile phone, it considerably addresses shortcomings of the external antenna and facilitates its fabrication comparing with the external antenna. However, the related art IFA suffers limitations on the miniaturization and the light weight because it is formed in three dimensions.

Particularly, as functions of present-day mobile communication terminals diversify, development of a multiband antenna is under way to transmit and receive radio signals of various bands. To follow this, the IFA is developed to operate in the dual-band. However, a dual-band IFA has a pair of radiators operating in the dual-band and this causes the inevitable size increase of the antenna.

Thus, miniaturization the dual-band IFA is needed.

When the mobile communication terminal is used, the IFA has a lower specific absorption rate (SAR), which is the Radio Frequency (RF) power absorbed by the human body per unit of mass of an object (W/Kg), than the external antenna. Since the mobile communication terminal is used adjacently to the human body, lower SAR is necessary.

Methods of lowering the SAR include using a directional antenna, shielding from radio waves by attaching a separate conducting plate, and inserting a radio wave absorber. However, those methods mostly increase the antenna size and thus are not suitable for the antenna of the mobile communication terminals.

Therefore, what is needed is a solution to lower the SAR of the IFA and miniaturize the IFA.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a dual-band IFA which can decrease the SAR and can be miniaturized.

According to an aspect of the present invention, there is provided an IFA which reduces the SAR, including a ground; an auxiliary radiator which is attached to one end of the ground and disposed along a plane direction of the ground; a radiator which lies at an interval from the auxiliary radiator in parallel and radiates electromagnetic waves; a feed which supplies current to the radiator; and a short which interconnects the radiator with the ground and discharges the current to the ground.

The auxiliary radiator may be formed of a strip line which is bent several times in a helical shape.

The auxiliary radiator may be formed in a rectangular shape, and the strip line which has a long side, may be connected to the ground.

The radiator may be connected to the short and the feed, and the radiator may include a first radiation part extending along the long side of the auxiliary radiator.

The radiator may include a second radiation part which has a first part and a third part on both sides of the first radiation part in parallel, and a second part connecting the first part to the third part and is bent downward to the auxiliary radiator in a 'U' shape.

The first radiation part and the second radiation part may radiate electromagnetic waves of different frequency bands.

The auxiliary radiator may be apart from the second part by a distance.

The length of the auxiliary radiator may be about $\lambda/2$ of the first radiation part and about $\lambda/4$ of the second radiation part.

BRIEF DESCRIPTION OF THE DRAWING FIGURES

The above and other aspects of the present invention will become more apparent by describing in detail exemplary embodiments thereof with reference to the attached drawing figures, wherein.

DETAILED DESCRIPTION OF EXEMPLARY EMBODIMENTS OF THE PRESENT INVENTION

Figure 1:
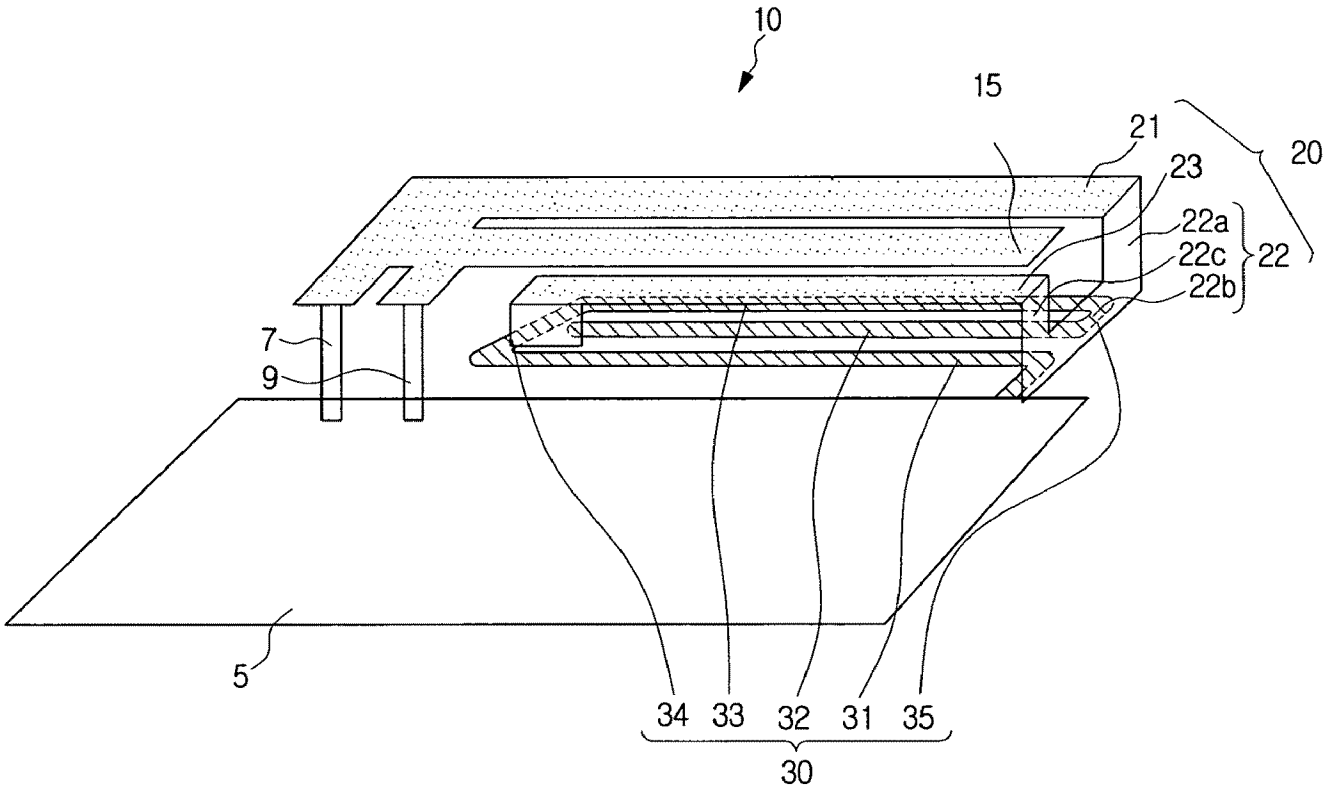
FIG. 1 is a perspective view of a dual-band inverted F antenna (IFA) according to an exemplary embodiment of the present invention.

Hereinafter, exemplary embodiments of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
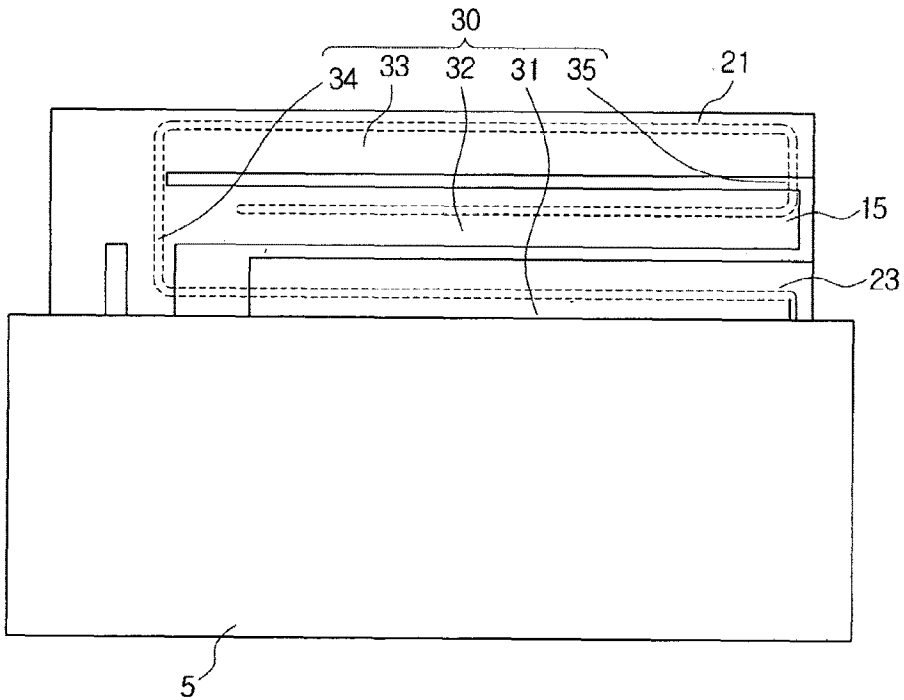
FIG. 2 is a front view of the dual-band IFA of FIG. 1.

FIG. 1 is a perspective view of a dual-band IFA according to an exemplary embodiment of the present invention, and FIG. 2 is a front view of the dual-band IFA of FIG. 1.

The IFA includes a radiator 10, an auxiliary radiator 30, a ground 5, a short 7, and a feed 9.

The ground 5 is integrally formed on a circuit board and responsible to discharge the remaining current of the radiator 10.

The radiator 10 has a first radiation part 15 and a second radiation part 20 which radiate electromagnetic waves in different operating frequencies. The short 7 and the feed 9 are coupled to one end of the radiator 10 facing the ground 5. The short 7 guides the remaining current of the radiator 10 to the ground 5, and the feed 9 supplies power to the radiator 10. An area of the radiator 10 between the short 7 and the feed 9 is cut open.

The first radiation part 15 is formed in a long band shape extending from the area of the radiator 10, to which the short 7 and the feed 9 are coupled, along the side of the ground 5. The first radiation part 15 operates in a 1800-MHz frequency band to radiate electromagnetic waves. The frequency band of 1800 MHz is used as the personal communication system (PCS) band.

The second radiation part 20 includes a first part 21, a second part 22, and a third part 23. The first part 21 is disposed in parallel with the first radiation part 15 and is longer than the first radiation part 15. The third part 23 is disposed to put the first radiation part 15 between the first part 21 and third part 23 in parallel. The second part 22 interconnects the first part 21 with the third part 23 and is bent toward the auxiliary radiator 30.

The second part 22 includes a first bend 22*a* extending downward from the end of the first part 21, a second bend 22*b* extending from the end of the first bend 22*a* to the third part 23, and a third bend 22*c* extending upward from the end of the second bend 22*b* and is connected to the end of the third part 23. That is, the second part 22 is formed in a 'U' shape. The second bend 22*b* is adjacent to the auxiliary radiator 30. Accordingly, the second radiation part 20 and the auxiliary radiator 30 are nearly connected to each other, and thus the radiation of the electromagnetic waves is carried out at the auxiliary radiator 30.

The free end of the third part 23 is bent downward to the ground 5 and is extended to a distance. The third part 23 is shorter than the first part 21 in length.

As such, the second radiation part 20 is longer than the first radiation part 15. Thus, the second radiation part 20 operates in a 900-MHz band which is a lower frequency band than the first radiation part 15. Typically, the 900-MHz band is used as the Radio Frequency Identification (RFID) band.

The auxiliary radiator 30 is attached to one side of the ground 5 to generate the induced current by the radiator 10. The auxiliary radiator 30 is disposed in the same plane as the ground 5 and formed using a microstrip or wire bent several times.

The auxiliary radiator 30 includes a first strip 31 disposed along the side of the ground 5 and is connected to the ground 5, and a second strip 32 and a third strip 33 disposed in parallel in that order at an interval from the first strip 31. At least one end of the first strip 31 and the third strip 33 are connected by a first connector 34, and the other ends of the second strip 32 and the third strip 33 are connected by a second connector 35. Thus, the auxiliary radiator 30 is formed in a helical shape of the single strip.

The auxiliary radiator 30 is placed at an interval from the radiator 10 in parallel. The length of the first and third strips 31 and 33 is shorter than the length of the radiator 10. The length of the connectors 34 and 35 is substantially equal to the width of the radiator 10.

The total length of the first, second and third strips 31, 32, and 33 and the first and second connectors 34 and 35 constructing the auxiliary radiator 30 is $\lambda/2$ with respect to the first radiation part 15 of a 1800 MHz operating frequency and is $\lambda/4$ with respect to the second radiation part 20 of a 900-MHz operating frequency.

Because the auxiliary radiator 30 is parallel to the first and second radiation parts 15 and 20 and the second part 22 of the second radiation part 20 is adjacent to the auxiliary radiator 30, the IFA induces the current to the auxiliary radiator 30. As a result, the electromagnetic waves are radiated at the auxiliary radiator 30 as well. The radiation of the auxiliary radiator 30 changes the distribution of the surface current of the IFA and can generate the third resonance.

Figure 3A:
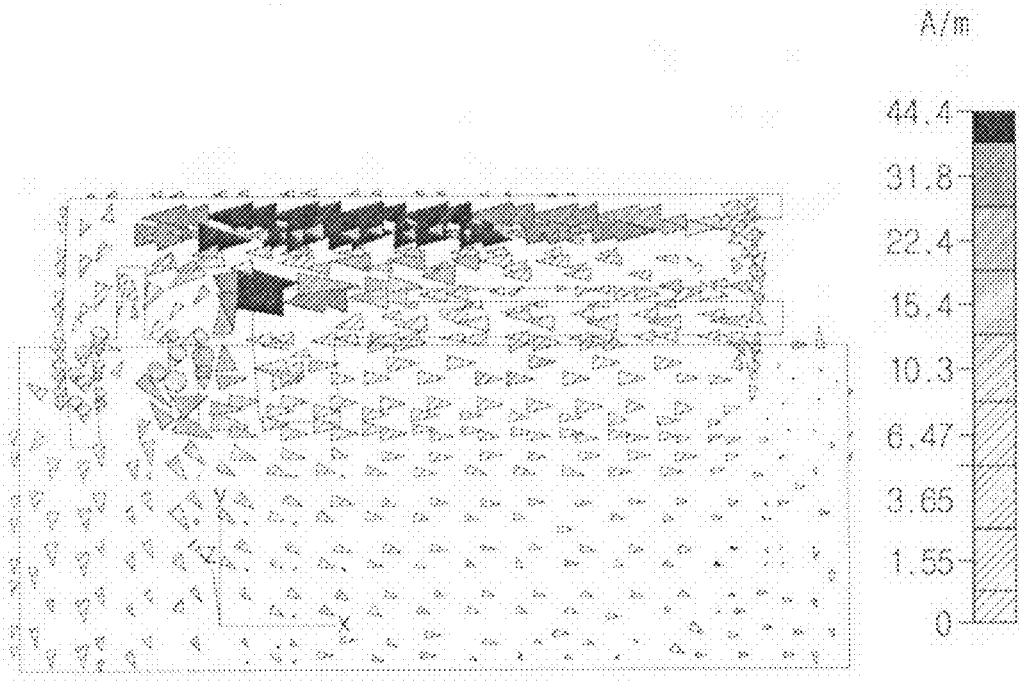
FIG. 3A (RELATED ART)
FIG. 3A is a diagram showing distribution of surface current when a first radiation part of a related art IFA operates.
Figure 3B:
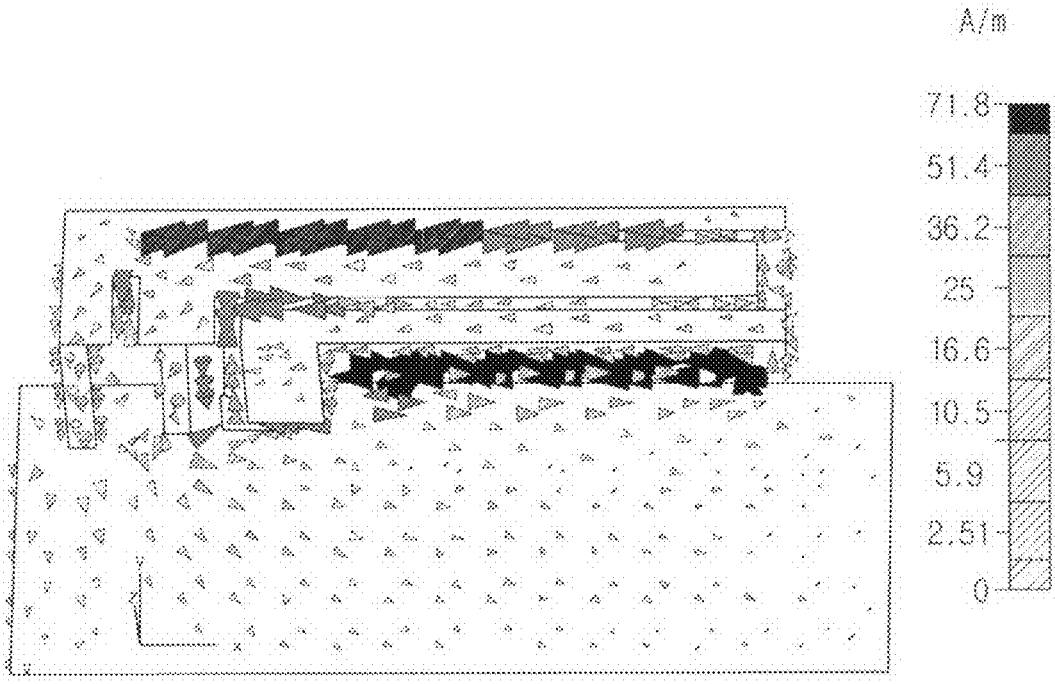
FIG. 3B is a diagram showing distribution of surface current when a first radiation part of the IFA of FIG. 1 operates.

FIG. 3A is a diagram showing distribution of surface current when operating a first radiation part 15 of a related art IFA, and FIG. 3B is a diagram showing distribution of surface current when operating the first radiation part 15 of the IFA of FIG. 1.

Referring to FIG. 3A, in the related art IFA, a great amount of the surface current is distributed over the first and second radiation parts 15 and 20 radiating as well as the ground 5. However, since the circuit board having the ground 5 is close to the human body when using the mobile communication terminal, the related art IFA produces a relatively high SAR.

Referring to FIG. 3B, the surface current of the ground 5 is reduced because a great amount of the surface current is distributed over the auxiliary radiator 30 being mounted. Thus, the IFA of the present invention drastically decreases the SAR, as compared to the related art.

In conclusion, the IFA changes the distribution of the surface current by virtue of the attachment of the auxiliary radiator 30 and thus lowers the SAR.

Figure 4:
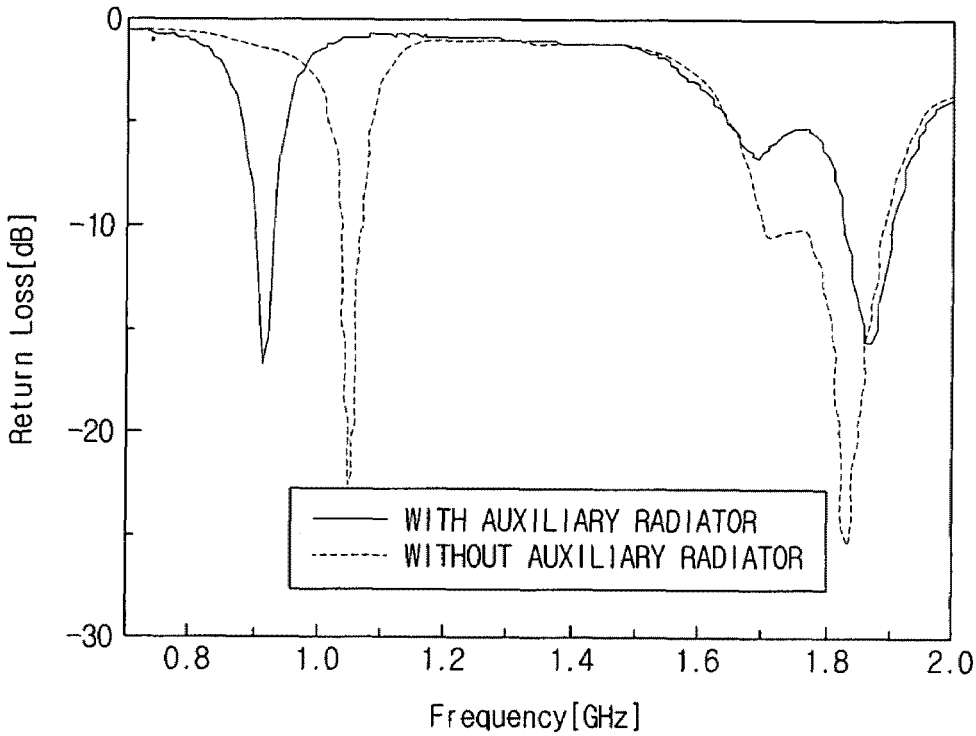
FIG. 4 is a graph showing a return loss of the antenna before and after mounting an auxiliary radiator.

FIG. 4 is a graph showing a return loss of the antenna before and after mounting the auxiliary radiator 30. It is noted that the size of the components of the IFA of the present invention is the same as in the related art IFA, and that the only difference of the two IFAs is the presence and the absence of the auxiliary radiator 30.

The related art IFA generates the operating frequency in the frequency bands of 1000 MHz and 1800 MHz. By contrast, the IFA of the present invention generates the operating frequency in the frequency bands of 900 MHz and 1850 MHz. That is, under the same conditions, the IFA of the present invention lowers the low frequency band radiated from the second radiation part 20 by 100 MHz or so.

Therefore, the IFA of the present invention can shorten the length of the second radiation part 20, as compared to the related art IFA.

As a result, since the auxiliary radiator 30 connected to the ground 5, the IFA reduces the surface current of the ground 5 and decreases the SAR. In addition, the antenna size can be miniaturized by lowering the operating frequency in the low frequency band.

In light of the foregoing, the SAR can be decreased and the antenna size can be miniaturized.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An inverted F antenna (IFA) which reduces a specific absorption rate (SAR), the IFA comprising:

a ground;

an auxiliary radiator which is attached to one end of the ground and disposed along a plane direction of the ground;

a radiator which is disposed in parallel with and at an interval from the auxiliary radiator, and radiates electromagnetic waves;

a feed which supplies current to the radiator; and a short which connects the radiator with the ground and discharges the current to the ground, wherein the auxiliary radiator comprises a strip line which is bent several times in a helical shape, the radiator is connected to the short and the feed, and the radiator includes a first radiation part extending along the long side of the auxiliary radiator, and the radiator includes a second radiation part which has a first part and a third part on both sides of the first radiation part in parallel and a second part connecting the first part to the third part and bent downward to the auxiliary radiator in a "U" shape;

wherein the first part is connected to one end of the second part where the second part bends down in the 'U' shape, and the third part is connected to the other end of the second part where the second part bends down in the 'U' shape; and wherein the first radiation part is directly connected to the first part but is not directly connected to the second part and the third part.

2. The IFA as in claim 1, wherein the auxiliary radiator has a rectangular shape, and the strip line is connected to the ground.

3. The IFA as in claim 1, wherein the first radiation part and the second radiation part radiate electromagnetic waves of different frequency bands.

4. The IFA as in claim 1, wherein the auxiliary radiator is apart from the second part by a distance.

5. The IFA as in claim 1, wherein a length of the auxiliary radiator is approximately $\lambda/2$ of the operating frequency of the first radiation part and about $\lambda/4$ of the operating frequency (whose $\lambda$ is the wavelength) of the second radiation part.

6. The IFA as in claim 1, wherein the auxiliary radiator comprises a strip line which is bent into several straight segments forming a spiral shape.

7. The IFA of claim 1, wherein the first part of the second radiation part, the third part of the second radiation part, and the first radiation part as disposed in parallel in the same plane.

8. The IFA of claim 1, wherein the first and third parts of the second radiation part are disposed in the same plane as the first radiation part.

9. The IFA of claim 1, wherein the second part of the second radiation part is substantially perpendicular to the first and third parts of the second radiation part.

10. The IFA of claim 8, further comprising a tab which extends down from the third part of the second radiation portion.

11. The IFA of claim 1, wherein a length of the auxiliary radiator of a longer side is shorter than the length of the radiator of a longer side.

* * * * *